United States Patent [19]

Hughes

[11] Patent Number: 4,489,438

[45] Date of Patent: Dec. 18, 1984

[54] AUDIO RESPONSE SYSTEM

[75] Inventor: Steve A. Hughes, Doraville, Ga.

[73] Assignee: National Data Corporation, Atlanta, Ga.

[21] Appl. No.: 344,505

[22] Filed: Feb. 1, 1982

[51] Int. Cl.[3] ..... G10L 1/00

[52] U.S. Cl. ..... 381/51; 364/513.5; 179/2 A

[58] Field of Search ..... 381/51–53; 179/2 R, 2 A, 6.01, 6.03, 6.07, 6.11; 364/513.5

[56] References Cited

U.S. PATENT DOCUMENTS

| | | | |
|---|---|---|---|
| 3,647,972 | 3/1972 | Glover et al. | 179/2 DP |
| 3,800,283 | 3/1974 | Gropper | 340/149 A |
| 3,820,071 | 6/1974 | Angus | 340/149 A |
| 3,823,308 | 7/1974 | Goldberg | 235/61.7 B |
| 3,925,622 | 12/1975 | Robinson | 179/6.03 |
| 4,013,838 | 3/1977 | Tsai | 179/2 A |
| 4,023,014 | 5/1977 | Goldberg | 235/61.7 B |
| 4,088,838 | 5/1978 | Nakata et al. | 179/2 A |
| 4,314,103 | 2/1982 | Wilson | 179/6.11 |
| 4,327,251 | 4/1982 | Fomenko et al. | 179/6.11 |

OTHER PUBLICATIONS

Holding et al., "Digital Voice Store and Forward . . . ", Electronics, Apr. 21, 1983, pp. 139–143.

*Primary Examiner*—L. S. Matt Kemeny

*Attorney, Agent, or Firm*—Schwartz, Jeffery, Schwaab, Mack, Blumenthal & Koch

[57] ABSTRACT

The system receives line signals including tone coded information request messages from a telephone line and transmits synthesized human voice response messages along the same line. The system comprises a programmed computer, a processing section connected to the telephone line to receive signals from the telephone line, and an interface circuit for providing communication between the processing section and the computer. A plurality of processing sections are used with a plurality of telephone lines, with only one interface circuit being used to provide communication between all of the processing sections and the computer. Each processing section contains a voice synthesizer circuit, a line control circuit, and a tone decoder circuit. Each of these circuits provides a status signal when the circuit must communicate with the computer. The interface circuit includes an interrupt circuit which receives the status signals and provides an interrupt signal to the computer. Upon receipt of the interrupt signal, the computer interrogates a specialized circuit in the interface to determine the source of the interrupt signal and then communicates with the circuit causing the interrupt signal through the interface circuit. Communication with the computer is carried through a serial data bus line. The serial data is converted to parallel data in the interface circuit.

18 Claims, 7 Drawing Figures

A2
A3
A4
537
536
219
218
245
244
207
205
113
130
131
644
700
D
CLR
Ḡ
116
132
531
534
209
206
248
246
505
211
208
702
Y
S
645
712
504
128
129
704
134
118
133
646
649
647
648
710
708
706
120
+5V
135

AUDIO RESPONSE SYSTEM

BACKGROUND OF THE INVENTION

1. Field of the Invention

The invention relates to systems designed to automatically provide answers to inquiries received over a telephone line and especially to such systems in which the answers are provided in the form of an audible human voice response.

2. Discussion of Related Art

There are many situations in which it is desirable to provide an audible human voice response to inquiries received over a telephone line. These situations include inquiries regarding credit card account balances for point of sale account status checks and other types of credit authorizations, telephone ordering, stock quotations, locator services, pay by phone services, home banking and check guarantee systems. In each instance, the information requested can be stored in a computer data bank and can readily be accessed by a computer terminal under the direction of a terminal operator. A difficulty arises when this information is to be transmitted over a telephone line to a particular requester. The most commonly used method is to have a terminal operator verbally transmit the information. However, this method can be excessively expensive due to the high cost of labor.

Systems have been suggested for eliminating the use of a human operator. For instance, U.S. Pat. No. 4,088,838 to Nakata et al shows a voice response system in which information is fed from telephone lines through a switching network to a receiver. The information is fed from the receiver to a data processor which operates to provide responses. The responses are fed to a voice synthesizer. The frequency spectrum of the synthesized voice is flattened for transmission over the telephone lines.

U.S. Pat. No. 4,013,838 to Tsai discloses a telephone inquiry system in which an automatic, instant response to a mailbox renter's telephone inquiry can be had. To inquire about a mailbox status, the renter calls a number and uses push buttons to enter his mailbox code. The system checks the status of the mailbox in question and informs the caller vocally by a voice response generator.

U.S. Pat. No. 3,800,283 to Gropper shows a credit verifying unit in which information stored on a credit card is read and transmitted to a computer by touch tone signals. The computer evaluates the information and transmits a signal which is displayed visually on a terminal at the point of sale.

U.S. Pat. No. 3,647,972 to Glover et al shows a portable terminal which generates and transmits selected tones over telephone lines to provide input to a computer.

U.S. Pat. No. 3,820,071 to Angus shows a credit card risk evaluation system in which a credit card reader transmits coded information to a central processing unit. The central processing unit evaluates the information and transmits a signal which is supplied to an audio playback device which stores and transmits several recorded messages.

U.S. Pat. No. 4,023,014 to Goldberg shows a credit card verifier which makes use of a computer for answering questions received over a telephone line in the form of tone signals. The tone signals are converted to digital signals and the answered questions are converted from digital to tone signals and transmitted over the same line.

While the patents discussed above show various substitutes for a human operator, none shows a system which is relatively inexpensive, compact and reliable, and capable of easily interfacing with known computer hardware. Many of the systems require point of sale terminals which greatly increase the cost of the system. Other of the systems are so complex as to require a large start-up cost and high maintenance costs thereby reducing their effectiveness as substitutes for human operators.

SUMMARY OF THE INVENTION

An object of the present invention is to provide an audio response system which is capable of decoding touch tone coded signals containing information to be responded to and producing a human voice audio response which can be readily understood.

Another object of the present invention is to provide a relatively inexpensive system for responding to telephone inquiries, which system includes a hardware oriented line interface system which is easily compatible with known digital computers.

A further object of the present invention is to provide an audio response system having a hardware oriented line interface system which can be used in a plurality of applications regardless of the data being transmitted and received.

Another object of the present invention is to provide an audio response system which is hardware oriented and designed such that any software required for the system can easily be generated by persons with minimal programming skill.

An even further object of the present invention is to provide an audio response system in which all of the hardware for the interface system of one or more communication lines can be mounted on a single printed circuit board.

An even still further object of the present invention is to provide an audio response system which is sufficiently inexpensive to manufacture that spare circuit boards containing the interface system hardware can be kept on hand to serve as replacements for malfunctioning circuit boards thereby substantially reducing the down time of the system due to malfunctions and, at the same time, reducing the level of skill required for on site repair and maintenance personnel.

Another object of the present invention is to provide an audio response system having a hardware oriented line interface system which can be used both remotely as a local concentrator for incoming information or on site at a main switching facility.

In accordance with the above and other objects, the present invention is a system for receiving tone coded messages from a telephone line and transmitting synthesized human voice messages along the same line. The system comprises a programmed computer containing information to be transmitted in response to the tone coded messages. A line control circuit produces an off hook signal in response to an incoming signal on a telephone line. An interface circuit establishes communication with the computer and contains an interrupt circuit for causing an interrupt signal to be transmitted to the computer in response to the off hook signal. Incoming tones are received by a tone decode circuit which produces digital numbers in response to received tones.

The interface circuit contains a tone decode interface for receiving the digital signals from the tone decode circuit and transmitting the signals to the computer in response to instructions from the computer. Once an incoming message is decoded and transmitted to the computer, the computer provides a response which is transformed by a voice synthesizing circuit into a synthesized human voice signal which is transmitted over the telephone line on which the original message was received.

The voice synthesizer circuit, when running dry of commands, outputs a memory status output signal to the interrupt circuit, which in turn interrupts operations in the computer. The computer responds by interrogating the interrupt circuit to determine the cause of the interrupt. The computer then provides additional commands to the synthesizer circuit, as necessary.

In accordance with other aspects of the invention, the tone decode circuit includes structure for producing a decode status signal in response to a received tone signal. The interrupt circuit is connected to receive the decode status circuit and cause an interrupt signal to be transmitted in response thereto. The interface circuit also includes a multiplexing control for individually enabling the voice synthesizing circuit or the tone decode circuit. The multiplexing control includes a first addressable latch circuit having an enable input and a data input connected to the computer. The latch also has a plurality of addressable outputs and a plurality of gate circuits connected to the outputs. The multiplexing control also operates a second addressable latch circuit which has an enable input connected to an output of one of the gate circuits and a data input connected to the computer. The second latch circuit also has a plurality of addressable outputs which are connected, respectively, to the line control circuit and the tone decode circuit. Each of the latch circuits is connected to a common address bus over which the computer sends address codes. The codes are divided into a first set of addresses which operates the first latch and a second set of addresses which operates the second latch as well as interface circuitry for the tone decoder and voice synthesizer.

The interrupt circuit includes a status check circuit comprising a data selector having a plurality of addressable inputs connected respectively to receive signals from the line control circuit, voice synthesizing circuit and tone to code circuit. The data selector has an enable input connected to the computer and an output connected to the computer. The addressable inputs are accessed in accordance with addresses received from the computer on the address bus. The addresses are those of the second set of addresses.

The tone decode circuit, voice synthesizing circuit and line control circuit form one processing section for one telephone line. Each interface circuit can accommodate more than one processing section on a time sharing basis under computer control. The interface circuit and associated processing sections are mounted, on a single printed circuit board, and a plurality of such circuit boards can be connected to a single computer. Accordingly, as many telephone lines as desired can be easily accommodated by simply duplicating the contents of a circuit board as many times as desired.

BRIEF DESCRIPTION OF THE DRAWINGS

The above and other objects of the present invention will become more readily apparent as the invention becomes more fully understood based on the following detailed description, reference being had to the accompanying drawings in which like reference numerals represent like parts throughout and in which.

DETAILED DESCRIPTION OF THE PREFERRED EMBODIMENT

Figure 1:
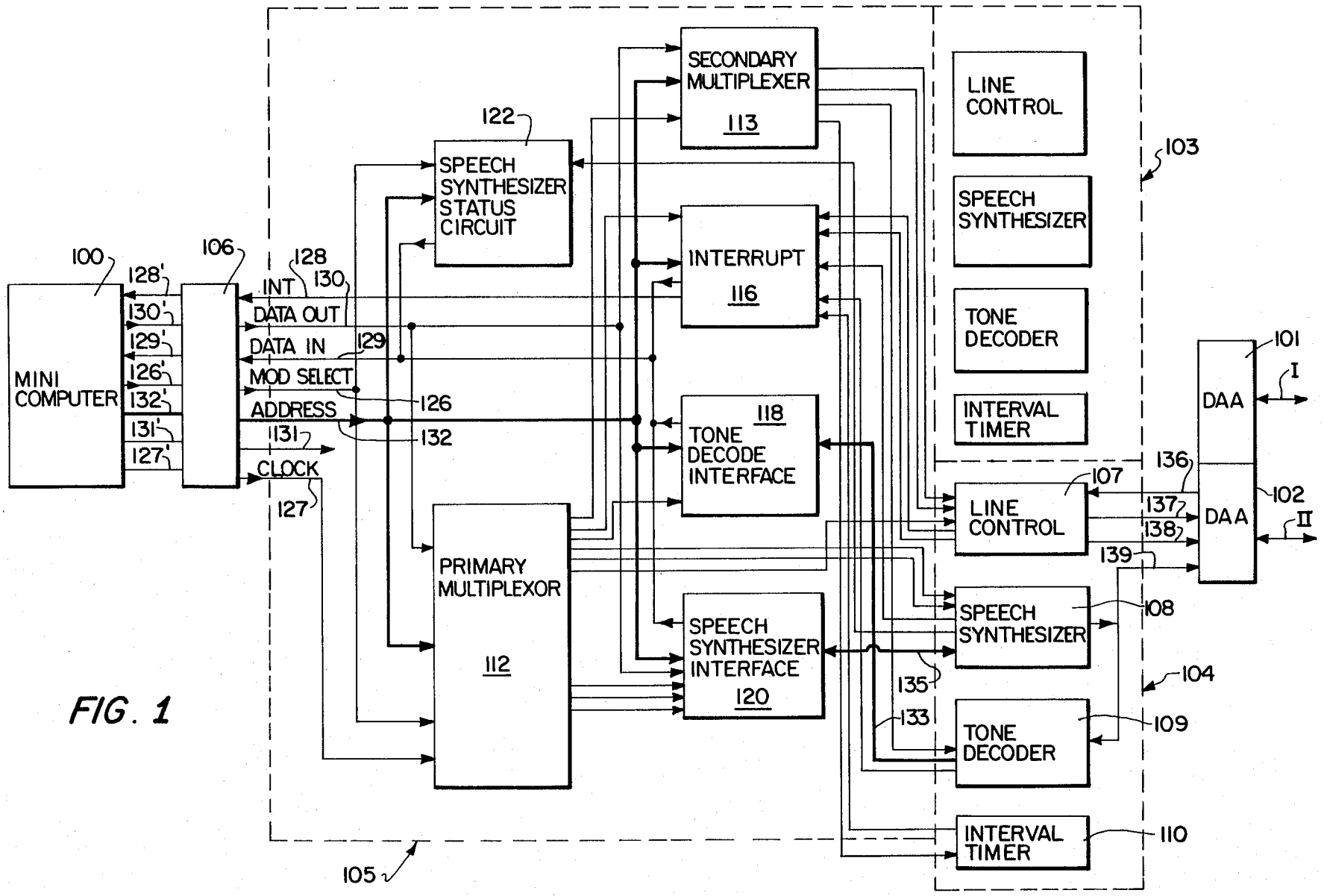
FIG. 1 is a block diagram of the system of the present invention.

FIG. 1 is a block diagram of the voice response system of the present invention. The system includes a minicomputer 100 which is preferably a member of the Texas Instruments Model 990 minicomputer family. In practice, a Model 990/5 has been used. Minicomputer 100 may contain system operating software and may be interconnected with larger main frame computer systems which contain data bases for answering inquiries to the system. Inquiries and responses are received and transmitted, respectively, over telephone lines I and II. The telephone lines enter direct access devices (DAA) 101 and 102, respectively. DAAs 101 and 102 are standard FCC approved station couplers. In practice, Elgin Electronics Model ESC20721 station couplers have been used. Of course, any similar device may also be used. DAAs 101 and 102 connect to processing sections 103 and 104, respectively. Processing sections 103 and 104 are identical in construction and, thus, only the connections between DAA 102 and processing section 104 are shown for simplicity, it being understood that similar connections are made between DAA 101 and section 103. Processing sections 103 and 104 both interconnect to interface section 105. The interconnections between interface section 105 and processing sections 103 and 104 are similar and, thus, for simplicity, only the interconnections between processing section 104 and interface section 105 are shown. Interface section 105 connects through interconnect device 106 to minicomputer 100.

Processing section 104 comprises line control circuit 107 which senses the existence of an incoming call by receipt of an "off hook" signal from DAA 102 on line 136, and controls the status of DAA 102 and telephone line II by signals transmitted on lines 137 and 138. Incoming touch tone signals are received on line 139 through DAA 102 and decoded in tone decoder 109. Outgoing speech signals are synthesized in speech synthesizer 108 and transmitted through line 139 and DAA 102 to the telephone line. Processing section 104 also contains an interval timer 110 which can be used to time the duration of various functions, such as providing a predetermined time period for an incoming call to be processed.

Ultimate control of circuits 107 through 110 is effected by minicomputer 100. Computer 100 outputs signals on a reset line 131 by which all of the circuits of sections 103, 104 and 105 are reset upon start-up. A computer clock signal is emitted on line 127 for controlling timing functions and a module select line 126 controls the operative state of interface circuit 105 with which the computer communicates. Circuit components of circuit 105 are controlled by address bus 132 which contains four address lines and operates in conjunction with data output line 130. Data being read by the computer is received in serial format on data input line 129 while any interrupts generated are received on interrupt line 128.

Computer control of the system is effected through primary multiplexer 112 which individually enables secondary multiplexer 113, interrupt 116, tone decode interface 118 or speech synthesizer interface 120 as well as controls certain functions of line control circuit 107 and speech synthesizer 108. Multiplexer 112 is enabled by a signal through line 126 and operates under control of address information received on bus 132.

Secondary multiplexer 113 is enabled by primary multiplexer 112 and functions under control of addresses received on address bus 132 to control the status of line control circuit 107, tone decode circuit 109 and interval timer 110. The state of each of the circuits 107 through 110 is transmitted by a signal on a separate line to interrupt circuit 116. Upon receipt of any status signal, circuit 116 outputs an interrupt on line 128 to computer 100. Status information concerning the circuit causing the interrupt can be obtained by the computer by enabling interrupt circuit 116 through mutliplexer 112 and accessing various input lines under the control of address bus 132. Information is then sent in serial format by circuit 116 to the computer over input line 129.

Information generated by tone decode circuit 109 is transmitted on data bus 133 to tone decode interface 118. When enabled by multiplexer 112, decode interface 118 transmits the information in serial format across line 129 in a sequence determined by address bus 132.

Information can be transmitted to and received from speech synthesizer circuit 108 through a data bus 135 which connects to speech synthesizer interface circuit 120. Circuit 120 is enabled by multiplexer 112 and receives information in serial format from computer 100 on line 130, which information is then transmitted to circuit 108 in parallel format. Conversely, parallel information from synthesizer circuit 108 is received by circuit 120 and transmitted in serial format along line 129 to computer 100. Circuit 120 operates under the control of addresses on address bus 132.

Speech synthesizer status circuit 122 can be interrogated by computer 100 to determine when information is being written into or read out of speech synthesizer circuit 108.

It should be clearly understood that only one interface circuit 105 is used for both processing section 104 and processing section 103. Consequently, each component of circuit 105 performs the same function with respect to section 103 circuits as has just been described with respect to circuits of section 104. The connections are the same but have been deleted for simplicity.

The basic operation of the system will now be discussed. When a call is sensed on telephone line II by DAA 102, an off hook signal is transmitted to line control circuit 107 on line 136. Line control 107 then sends a signal to interrupt circuit 116. Circuit 116 immediately transmits an interrupt signal on line 128 to computer 100. Computer 100 then interrogates circuit 116 through multiplexer circuit 112 by transmission of an appropriate module select signal on line 126, an appropriate signal on bus 132, and a data signal on line 130. Multiplexer circuit 112 enables the status check function of interrupt circuit 116 and various inputs to circuit 116 are accessed by computer 112 along address 132. In this manner, computer 112 determines that the interrupt was caused by an off hook signal from line control circuit 107. In response, computer 100 then resets line control circuit 107 through primary multiplexer 112 and secondary multiplexer 113. Secondary multiplexer 113 is enabled by appropriate instructions through primary multiplexer 112. Thereafter, secondary multiplexer 113 resets circuit 107 in accordance with an address on bus 132 and data on line 130. Thereafter, a synthesized message is sent through speech synthesizer circuit 108 for the caller to input the request information. Information to be synthesized is inputted to circuit 108 through synthesizer interface 120 which is enabled by multiplexer 112 and receives the information in serial format from computer 100 on line 130. The information is output in parallel format on bus 135 to synthesizer 108, which is also enabled by multiplexer 112. Information is inputted to circuit 108 one byte at a time and the status of the information being inputted is monitored through status circuit 122. Computer 100 periodically checks circuit 122 which indicates when information is being written into or when information is being read from circuit 108. After the information to be synthesized is written into synthesizer circuit 108, the synthesis process begins. After a predetermined amount of the information has been synthesized, a memory status output signal is transmitted to interrupt 116 indicating that more speech information should be input to synthesizer 108. The signal produces an interrupt to computer 100 which interrogates interrupt circuit 116 to determine the cause of the interrupt. Thereafter, additional information to be synthesized is input to synthesizer 108 as discussed above. Synthesizer 108 can be interrogated by synthesizer interface 120 whereby information is read through bus 135 to determine when all synthesized speech has been output through line 139. When this is done, interval timer 110 can be started through multiplexers 112 and 113 to provide a predetermined amount of time for request information to be received along the telephone line.

Incoming request information is in the form of touch tone code pulses which are received by tone decoder circuit 109. Upon receipt of each tone, circuit 109 outputs a decode status signal to interrupt 116 which transmits an interrupt signal to computer 100 and is interrogated thereafter. Decoder circuit 109 translates the received tone into a digital number and outputs the number in parallel format on data bus 133. Computer 100 thereafter enables tone decode interface circuit 118 through multiplexer circuit 112. Tone decode interface 118 transmits the digital information in serial format along line 129 under control of the computer on address bus 132. After the digital numeral is received by computer 100, a signal is transmitted to tone decoder circuit 109 by appropriate operation of primary multiplexer 112 and secondary multiplexer 113 to clear the decoder. This clear signal resets the tone decoder to prepare it for reception of a further tone.

After all digital information has been received by computer 100, an appropriate response is transmitted to synthesizer 108 and output as a voice signal along telephone line II. Computer 100 monitors the status of synthesizer 108 through interface 120 and when all speech signals have been output causes the phone line to be disconnected through line control circuit 107.

The individual components of the system will now be discussed.

Figure 6:
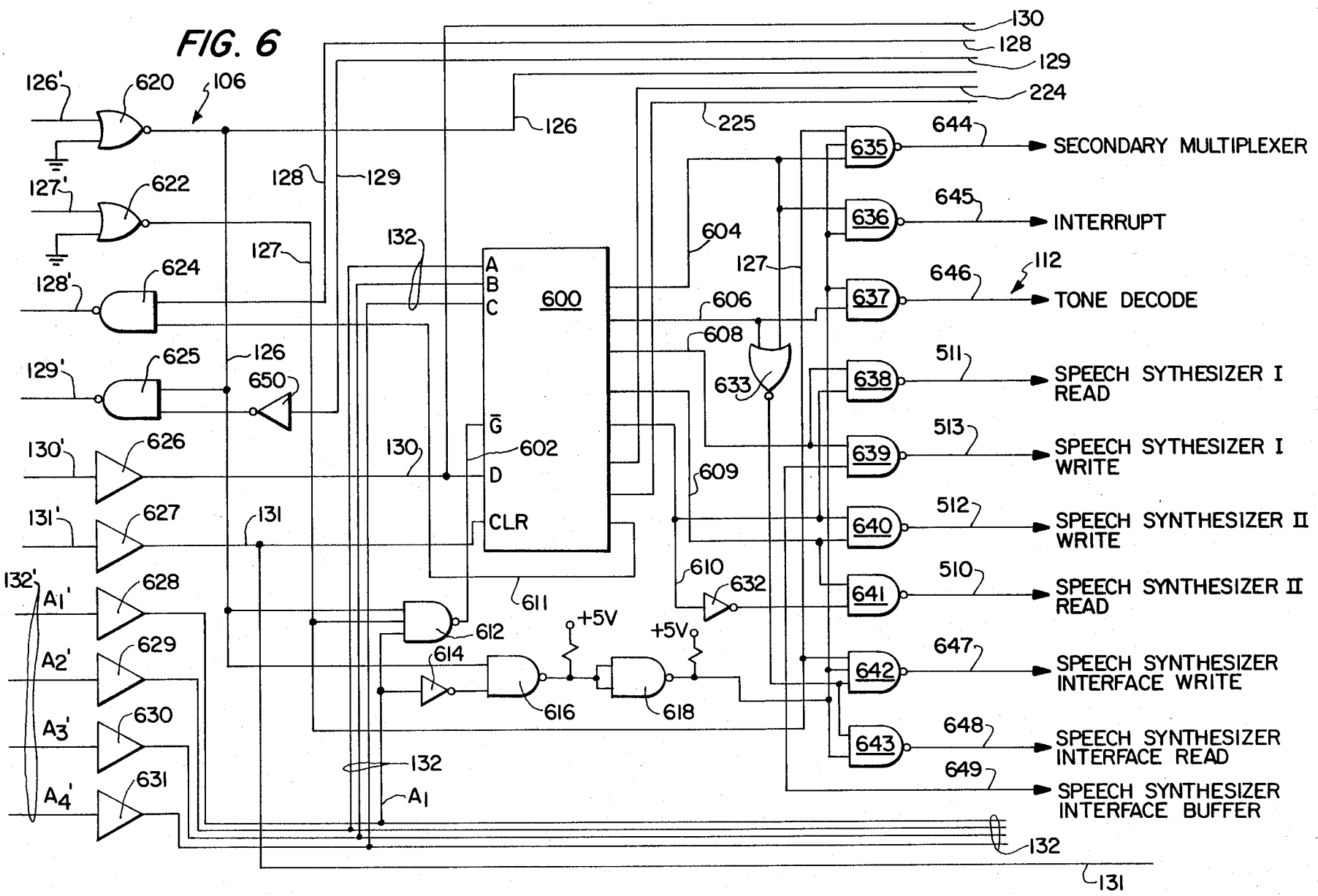
FIG. 6 is a schematic diagram of the primary multiplexer circuit of the present invention.

FIG. 6 shows interconnect circuitry 106 and the primary multiplexer circuit 112. Interconnect circuitry 106 comprises NOR gates 620, 622, NAND gates 624, 625 and amplifiers 626–631. Module select line 126 and clock line 127 are connected respectively to NOR gates 620 and 622. Interrupt line 128 connects to NAND gate 624 which also receives an enable input on line 611 from integrated circuit 600 of multiplexer circuit 112. Data input line 129 is connected to inverter 650, the output of which connects to NAND gate 625. The other input of NAND gate 625 is coupled to module select line 126 such that the data input is disabled when line 126 is active. Data output line 130, reset line 131 and lines $A_1$ through $A_4$ of address bus 132 are connected to amplifiers 626 through 631, respectively.

Primary multiplexer 112 contains an 8-bit addressable latch circuit which can be, for example, a Texas Instruments type SN54259 integrated circuit. Circuit 600 is a register having 8 addressable outputs connected to lines 604, 606, 608, 609, 610, 611, 224 and 225, respectively. Circuit 600 also has three latch select inputs which are connected to lines A2, A3 and A4 of address bus 132. A data input is connected to line 130, an enable input is connected to line 602 and a clear input is connected to line 131. At system start-up, circuit 600 is cleared by a signal on line 131. Thereafter, data on line 130 in the form of a high or low signal is stored and transferred to the output line addressed by the inputs on address bus 132.

Enable line 602 is connected to the output of NAND gate 612 which receives inputs from module select line 126, clock line 127 and address bus line $A_1$. The output of NAND gate 612 should be low to enable circuit 600. Accordingly, circuit 600 is enabled whenever module select line 126 is high, line $A_1$ is high and clock line 127 goes high. At this time, whatever data is on line 130 is transferred to the output indicated by lines A2 through A4 of address bus 132.

The outputs of circuit 600 are connected to gating circuits comprising NAND gates 635 through 643, NOR gate 633 and inverter 632. Output lines 644 through 646 from NAND gates 635 through 637 enable secondary multiplexer circuit 113, the status check function of interrupt circuit 116 and tone decode interface, respectively. Output lines 511 and 513 from NAND gates 638 and 639 enable the read and write functions of the speech synthesizer circuit of processing section 103 while output lines 512 and 510 from NAND gates 640 and 641 enable the write and read functions of speech synthesizer 108 of processing circuit 104. Output lines 647 and 648 from NAND gates 642 and 643, respectively, enable the read and write functions of speech synthesizer interface 120.

NAND gate 635 also has an input from clock line 127 and another input from a network comprising NAND gate 618, NAND gate 616 and inverter 614. The input to inverter 614 is from line $A_1$ and the inputs to NAND gate 616 are from the inverter 614 and from module select line 126. In order for the secondary multiplexer to be enabled, the signal on line 644 must be low. Accordingly, it can be seen that the signal on output line 604 must be high when the module select signal on line 126 is high and the signal on line $A_1$ must go low for the secondary multiplexer to be selected. Conversely, in order for circuit 600 to be enabled, line $A_1$ must be high at the same time that clock line 127 and module select line 126 are high.

The result of this configuration is that with line $A_1$ high, the primary multiplexer is enabled and signals on lines $A_2$ through $A_4$ are used to address an output line of circuit 600. Once a circuit is selected, line $A_1$ is dropped to a low state and addresses on lines $A_2$ through $A_4$ are used to address locations in the circuit selected by the primary multiplexer circuit.

The inputs to NAND gate 636 are the same as to NAND gate 635 except there is no input from the clock line 127. Accordingly, the status check function of interrupt circuit 116 is enabled each time the secondary multiplexer circuit is enabled except that the interrupt circuit can be enabled whether the clock output is high or low. Accordingly, the computer is programmed such that when the clock output is high, any signals on data input line 129, which may come from interrupt circuit 116, are ignored and the signals are only retrieved when the clock signal is low.

The inputs to NAND gate 637 consist of output lines 606 from circuit 600 and the output from NAND gate 618. Accordingly, the touch tone decode interface circuit is enabled when line 606 goes high after which line $A_1$ goes low so that the enabled touch tone decode interface circuit 120 can be operated by address information on address bus 132 lines $A_2$ through $A_4$.

Output line 608 constitutes the control line for the voice synthesizer circuit of processing section 103 and connects to NAND gates 638 and 639. Line 609 performs the same function for voice synthesizer circuit 108 of processing section 104. Line 610 controls the read/write function for the voice synthesizer circuits. This function will be described in detail hereinafter. When line 610 is high, either the voice synthesizer circuit of processing section 103 or processing section 104 is placed in the read mode, depending on whether line 608 or 609 is high. Conversely, if line 610 is low, the write function of the appropriate synthesizer is enabled depending on whether line 608 or 609 is high. An additional output is taken from inverter 632 on line 649. This output serves to disable a buffer in the write portion of speech synthesizer interface 120 when read operation is commanded.

NAND gates 642 and 643 each contain an input from NOR gate 633. The inputs of NOR gate 633 are from lines 604 and 606, respectively. NAND gates 642 and 643 control the write and read functions, respectively, of speech synthesizer interface 120. Accordingly, NOR gate 633 ensures that both write and read functions are disabled when any one of the secondary multiplexer circuits, the interrupt status check circuits or the tone decode interface circuit is enabled. NAND gates 642 and 643 each also have an input connected to the output of NAND gate 618. Consequently, it can be seen that the read function of interface circuit 120 is enabled whenever the output of NAND gate 618 goes high and lines 604 and 605 are low. NAND gate 642 has an additional input from clock line 127. Accordingly, the write function of interface 120 is only enabled when the clock input is high. To distinguish between the read and write functions of synthesizer interface 120, the computer would only read information received from the synthesizer when the clock line is low.

Figure 2:
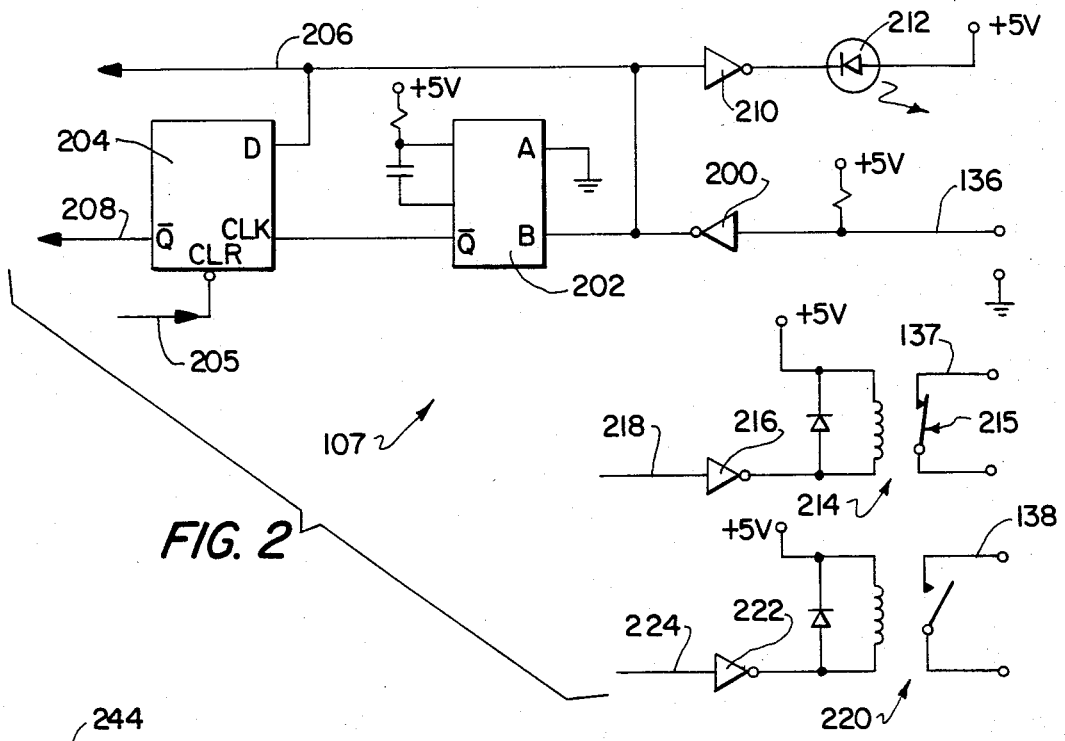
FIG. 2 is a schematic diagram of a line control circuit of the present invention.

FIG. 2 shows line control circuit 107. Circuit 107 comprises input line 136 from DAA 102. Line 136 acts as an input to inverter 200, the output from which enters monostable multivibrator 202 which is set for a pulse width of 50 milliseconds. The output of inverter 200 also enters inverter 210 and the data input of D-type flip flop 204. The output is also passed along line 206 to interrupt circuit 116. In operation, when an off hook signal is received on line 136, the signal is inverted in inverter 200 and inverted again in inverter 210. The voltage on line 136 goes low to indicate an off hook condition. Accordingly, the output of inverter 210 goes low thus illuminating LED 212 indicating the presence of a call on line II. The output of inverter 200 is also passed through line 206 to interrupt circuit 116 where it acts as a status indicating signal when accessed by the computer, as will be discussed hereinafter. The output of inverter 200 also initiates operation of MMV 202. When MMV 202 times out, a high signal at the data input of flip flop 204 causes the non-inverting output of the flip flop to go to a low state causing a low signal to be passed along line 208 to interrupt circuit 116 which causes an interrupt signal to be passed to computer 100. MMV 202 and flip flop 204 act as a time delay to compensate for any switch bounce effects which may cause a false interrupt signal. In other words, the off hook signal must remain for at least 50 milliseconds to ensure that it is a true signal. After the interrupt signal has been recognized by computer 100, an off hook acknowledge signal is returned along line 250 to reset flip flop 204.

Line 218 controls the operation of relay 214 through inverter 216. Relay 214 includes normally closed contacts 215 which are connected by line 137 to DAA 102. In order to disconnect telephone line II, computer 100 causes a hangup signal to be sent from secondary multiplexer 113 along line 218. The signal causes relay 214 to open contacts 215 thereby disconnecting the telephone line.

Line 214 is also connected to secondary multiplexer 113. Line 214 operates the contacts of relay 220 through inverter 222. In the open position, the contacts of relay 220 enable DAA 102. Accordingly, computer 100 can cause DAA 102 to be disabled by energizing relay 220 thus closing contacts 221. Disabling DAA 102 ensures that no incoming calls on line II will be answered. This function is useful if, for example, the data retrieval system of computer 100 is not operative.

Figure 3:
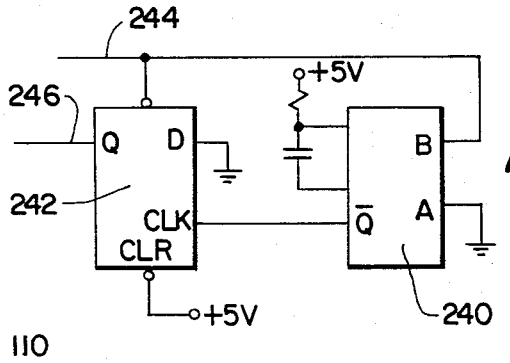
FIG. 3 is a schematic diagram of an interval timer of the present invention.

FIG. 3 shows interval timer 110. Interval timer 110 is a combination of monostable multivibrator 240 and D-type flip flop 242. The inverting output of MMV 240 is connected to the clock input of flip flop 242. The output of flip flop 242 is connected through line 246 to interrupt circuit 116. The timer operation is initiated by a pulse on line 244 which presets flip flop 242 and triggers MMV 240.

Figure 5:
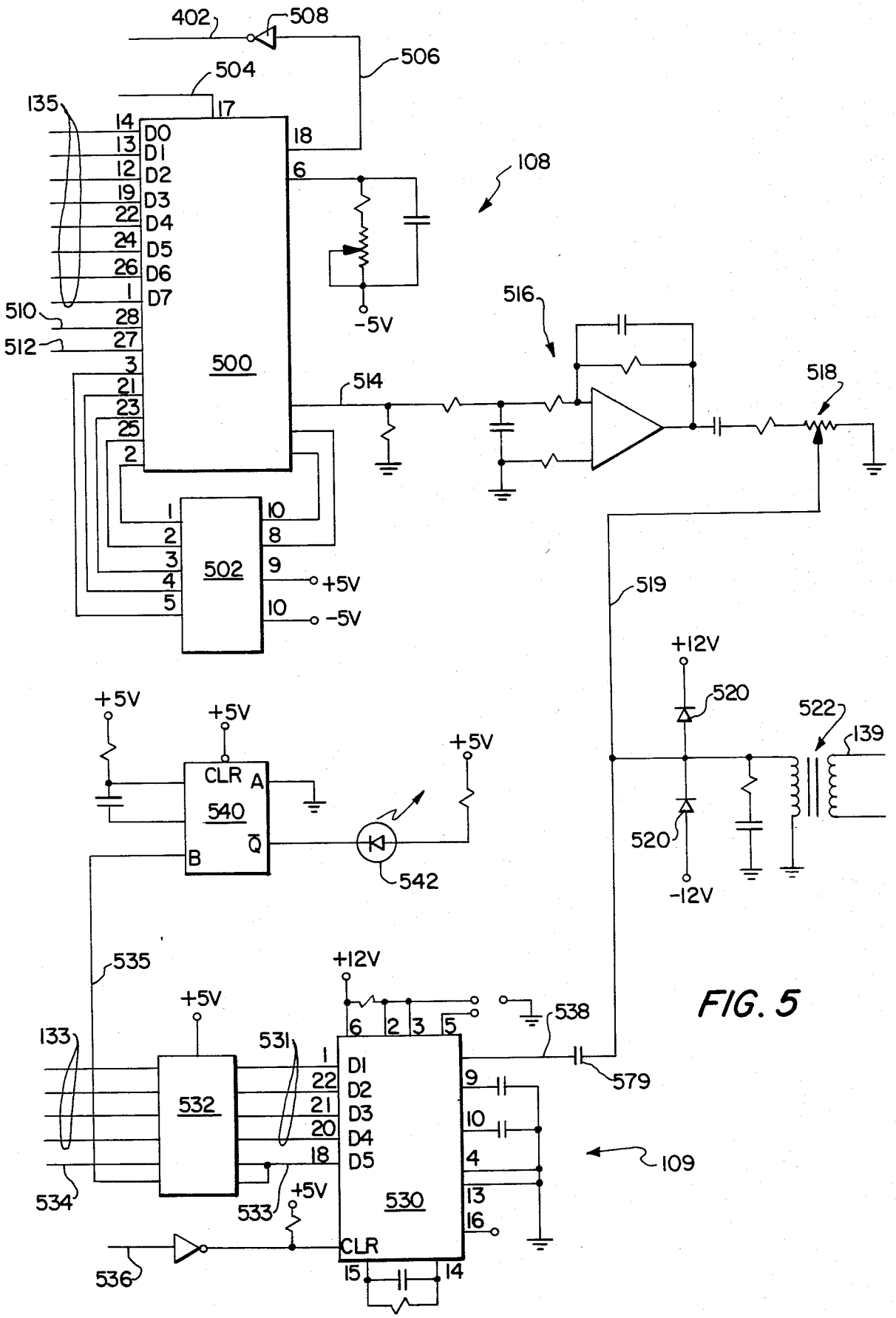
FIG. 5 is a schematic diagram showing the speech synthesizer circuit and tone decoder circuit of the present invention.

FIG. 5 shows the circuit configuration for speech synthesizer circuit 108 and tone decoder circuit 109.

Synthesizer circuit 108 comprises synthesizer chip 500 which is a TMS 5200 Voice Synthesis Processor integrated circuit manufactured and sold by Texas Instruments, Inc. Synthesizer chip 500 can be used with ROM 502 which is a TMS 6100 128K bit ROM manufactured and sold by Texas Instruments, Inc. Speech data that has been compressed using pitch excited linear predictive coding is supplied to synthesizer chip 500 either by computer 100 or by ROM 502. In the present invention, all speech data is supplied by computer 100. However, ROM 502 is made available for use, if desired.

Speech data can be entered in a memory buffer of synthesizer chip 500 one byte at a time through 8-bit bus 135. Bus 135 is a bidirectional bus and can also be used to read the status of the memory buffer. In order to write speech data into the memory buffer, write line 510 must be low and read line 512 must be high. In order to complete a read operation, line 510 must be high and line 512 must be low. Lines 510 and 512 are operated through NAND gates 641 and 640, respectively, of primary multiplexer 112, shown in FIG. 6. Data bus 135 connects to computer 100 through speech synthesizer interface 120.

The buffer memory of synthesizer chip 500 is a slow memory and requires wait states to successfully complete memory cycles. For this reason, a ready output is provide. This output is connected to line 504. The ready output goes high immediately when either line 510 or 512 goes active (low). Line 504 will stay high until synthesizer chip 500 has established stable data on data bus 135 in the case of the read operation or has completed latching data into the buffer memory from the data bus in the case of the write operation. Line 504 connects directly to speech synthesizer status circuit 122, shown in FIG. 1. Circuit 122 is interrogated periodically by computer 100 to determine when read and write operations have been completed.

Synthesizer chip 500 also includes an interrupt output connected to line 504. The interrupt output goes from low to high when the buffer memory is half depleted, that is, when half of the information in the buffer memory has been processed. A high status on line 504, therefore, indicates that more speech data should be supplied on bus 135. Line 504 connects to interrupt circuit 116.

The audio output of chip 500 is take on line 514. Line 514 is an input to filter circuit 516. Filter 516 is an active filter which enhances the high frequency component of the signal and limits the frequency spectrum to 3.8 KHZ. This is the permissible frequency limit for transmission over telephone lines. The output of filter 516 is passed through potentiometer 518 at which the voltage limit of the signal is set at approximately 0.5 volts, the permissible voltage limit for telephone lines. The signal is then passed through output line 519 to transformer 522. Diodes 520 are connected to the line 19 and act as surge suppressing diodes. The output of transformer 522 is passed through line 139 to DAA 102, as seen in FIG. 1.

Touch tone decode circuit 109 comprises a tone decode integrated circuit 530. Integrated circuit 530 is preferably a dual tone multiple frequency receiver Model SSI 201, manufactured and sold by Silicon Systems, Inc. Circuit 530 has an analog input connected to line 538. Line 538 is connected to receive analog touch tone signals from line 139 through transformer 522 and capacitor 539. Circuit 530 provides digital code in parallel format on an output bus 531 through buffer 532 to bus 133 which connects to tone decode interface 118, shown in FIG. 1. When a received tone has been decoded by circuit 530, a tone decode status signal is output on line 533 through buffer 532 to line 534 which connects to interrupt circuit 116, shown in FIG. 1. The same signal passes through buffer 532 to line 535 which is connected to monostable multivibrator 540. Monostable multivibrator 540 outputs a pulse which causes LED 542 to illuminate. Accordingly, LED 542 lights each time a tone signal is decoded by circuit 530.

Computer 100 senses the signal on line 534 through interrupt circuit 116 and causes the digital signal on bus 133 to be input to the computer through tone decode interface circuit 118. After each decoded tone is input to computer 100, a signal is passed through secondary multiplexer circuit 113 to line 536 which clears circuit 530 to prepare for the next received tone.

Figure 4:
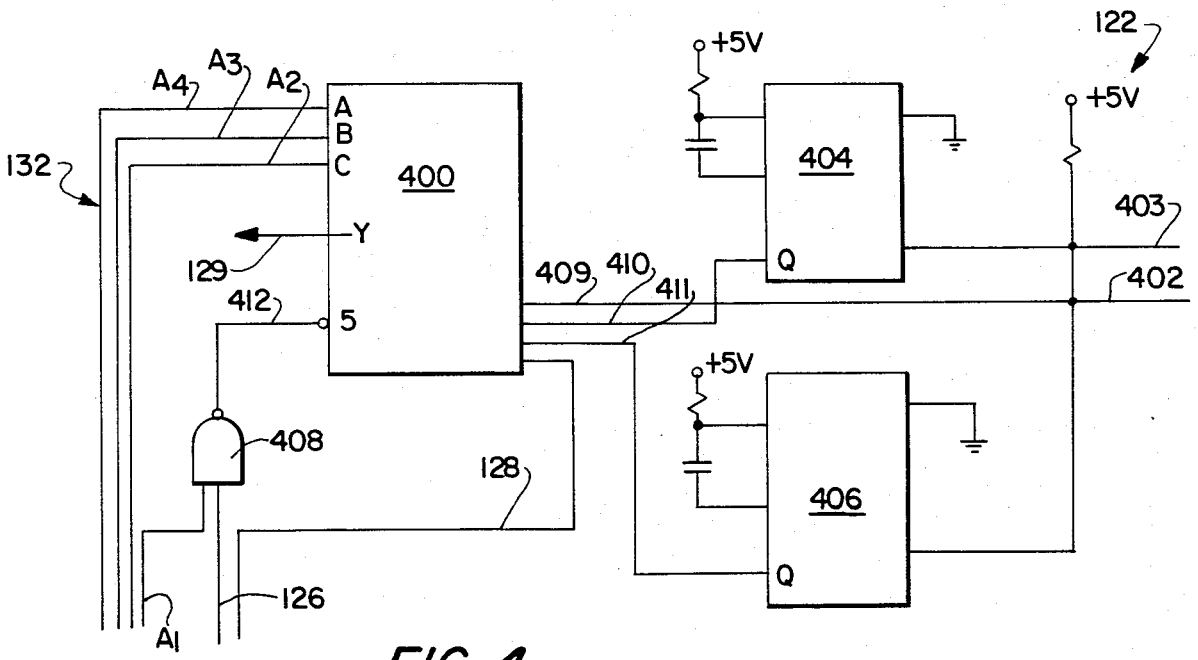
FIG. 4 is a schematic diagram of the speech synthesizer status register of the present invention.

FIG. 4 shows the speech synthesizer status circuit 122. Status circuit 122 comprises a data selector integrated circuit 400 which may be a Texas Instruments type SN54LS251 integrated circuit. Data selector circuit 400 has inputs connected to lines 128, 409, 410 and 411. Circuit 400 also has data select inputs connected to lines $A_2$, $A_3$ and $A_4$ of address bus 132. Circuit 400 causes the information on one of lines 128 and 409 through 411 to be transferred to line 129 connected to the circuit output in dependence upon the address on address bus 132. The information on the addressed input line is transferred to output line 129 when the circuit is strobed by a signal on line 412 connected to the strobe input. Line 412 is an output line from NAND gate 408. The inputs to gate 408 constitute address bus line $A_1$ and module select line 126. When both of these lines are high, the strobe input of circuit 400 is actuated.

Input line 409 is directly connected to line 402 from synthesizer circuit 108 shown in FIG. 5. Line 402 is also connected to monostable multivibrator 404 and monostable multivibrator 406. The outputs of these multivibrators are connectd to lines 410 and 411, respectively. Multivibrator 404 is constructed to produce a 12 microsecond time delay and multivibrator 406 produces a 50 microsecond time delay. Accordingly, line 409 inputs the signal from line 402 immediately, line 410 inputs a similar signal with a 12 microsecond delay and line 411 inputs a similar signal with a 50 microsecond time delay. The purpose of the time delays is to make the system compatible with various minicomputers.

Input line 128 is connected to interrupt circuit 116 and provides an indication to the computer of the existence of an interrupt when inputs of circuit 400 are being interrogated.

Line 403 shown in FIG. 4 comprises an input from processing section 103 having similar connections as those of line 402 from processing section 104.

Figure 7:
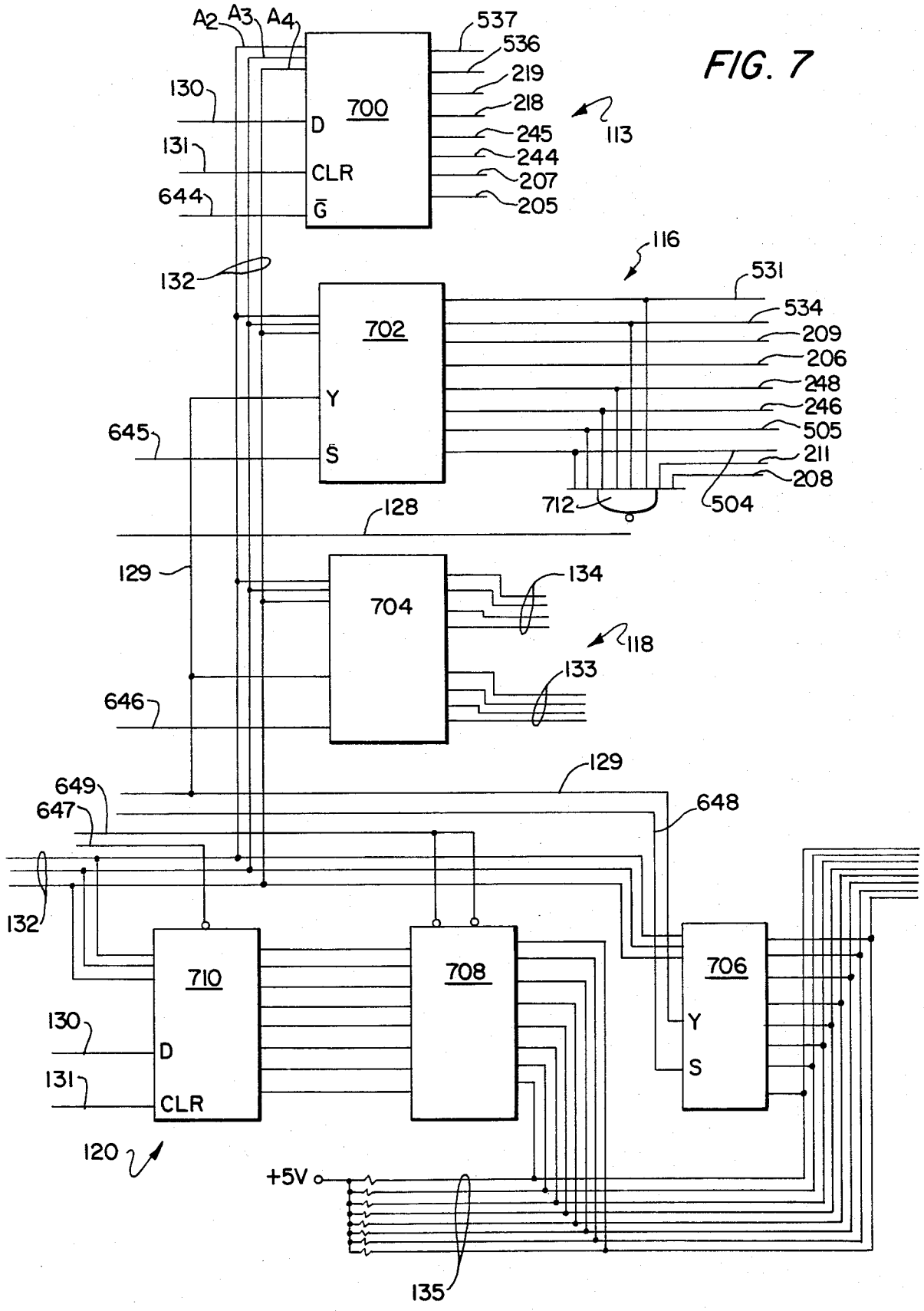
FIG. 7 is a schematic diagram showing the secondary multiplexer circuit, interrupt circuit, tone decode interface and speech synthesizer interface of the present invention.

FIG. 7 shows secondary multiplexer circuit 113, interrupt circuit 116, tone decode interface 118, and speech synthesizer interface 120.

Secondary multiplexer 113 comprises a Texas Instruments type SN74LS259 8-bit addressable latch similar to circuit 600 used in primary multiplexer circuit 112. The data input to circuit 700 is taken from line 130 from computer 100. The enable input is on line 644 from NAND gate 635 of primary multiplexer 112 shown in FIG. 6. A clear input is taken from reset line 131 from computer 100. The latch select inputs are connected to lines $A_2$, $A_3$ and $A_4$ of address bus 132. The outputs include line 536 which is the clear input line for circuit 530 shown in FIG. 5. Line 537 makes a similar connection in processing section 103. Output line 218 transmits a hangup signal to line control circuit 107. Output line 219 makes a similar connection in processing section 103. Output line 244 constitutes the timer start line for timer circuit 110, shown in FIG. 3. Line 245 constitutes a similar start line for the timer of processing section 103. Output line 205 constitutes the off hook acknowledge line used to clear flip flop 204 in line control circuit 107, shown in FIG. 2. Line 207 performs a similar function in the line control circuit of processing section 103. As can be easily seen, circuit 700 is enabled by primary multiplexer circuit 112 and the data provided on line 130 is latched onto the output line addressed by bus 132 to control the associated circuit components.

Interrupt circuit 116 comprises data selector circuit 702 and NAND gate 712. Circuit 702 can be a Texas Instruments type SN74LS251 similar to circuit 400 of speech synthesizer status circuit 122. Circuit 702 has an output connected to data input line 129 of computer 100. A strobe input is connected to line 645 from primary multiplexer 112. Lines $A_2$, $A_3$ and $A_4$ of data bus 132 are connected to the data select inputs of the circuit. One of the addressable inputs is connected to tone decode interrupt line 534. Line 534 is also an input to NAND gate 712. Input line 531 is connected to a second input of circuit 702 and to a second input of NAND gate 712. Line 531 has connections in the tone decode circuit of processing section 103 similar to the connections of line 504 in tone decode circuit 109. A third input is connected to line 206 which transmits the off hook signal from line control circuit 107. Line 209 is connected to a fourth input and transmits a similar off hook signal from the line control circuit of processing section 103. Line 208 transmits the off hook interrupt signal from line control circuit 107 and constitutes another input to NAND gate 712. Line 211 serves a similar function with respect to the line control circuit of processing section 103 and constitutes yet another input to NAND gate 712. Line 246 is the output line from timer 110 and provides inputs to circuit 702 and gate 712. Line 248 is the output line from the timer of processing section 103. Line 504 is the synthesizer interrupt line from synthesizer chip 500 and provides input signals to circuit 702 and gate 712. Line 505 is a similar synthesizer interrupt line from the synthesizer of processor section 103.

Clearly, a signal on any line connected to NAND gate 712 causes an interrupt signal to be transmitted along line 128 to computer 100. The computer then enables circuit 702 through primary multiplexer 112 on line 645 and sequentially accesses each of the input lines connected to circuit 702 to determine the cause of the interrupt. Once the cause of the interrupt is determined, the computer then takes other appropriate action, as discussed above.

Tone decode interface circuit 118 comprises a data select circuit which can be a Texas Instruments type SN74LS251 similar to circuit 702. The addressable inputs to circuit 704 are connected to two data buses. Four of the inputs are connected to data bus 133 which transmits decoded tone information from tone decode circuit 109 while the other data bus, data bus 134, is similarly connected to the tone decode circuit in processing section 103. The output of circuit 704 is connected to data input line 129 to computer 100 and the strobe input is connected to line 646 from NAND gate 637 of primary multiplexer 112. The data select inputs are connected to lines $A_2$, $A_3$ and $A_4$ of data bus 132. Circuit 704 acts as a parallel to serial converter under control of computer 100. The lines of each data bus 133, 134 are accessed sequentially thus serially inputting the data on one or both of the data buses to the computer under computer control.

Speech synthesizer interface 120 comprises a data selector circuit 706 which is another Texas Instruments type SN74LS251. The eight addressable inputs of circuit 706 are connected to data bus 135. Data bus 135 is connected to speech synthesizer 108 and is also connected to the speech synthesizer of processing section 103. The data select inputs are connected to lines $A_2$, $A_3$ and $A_4$ of address bus 132 and the strobe input is connected to line 648 which is connected to NAND gate 643 of the primary multiplexer circuit. The output of circuit 706 is connected to data input line 129 of computer 100. Circuit 706 acts as a parallel to serial converter under control of the computer for serially inputting information to the computer from a speech synthesizer during a read mode.

Circuit 120 also includes addressable latch 710 which can be a Texas Instruments type SN74LS259 integrated circuit. The addressable outputs of circuit 710 are connected to the inputs of octal buffer circuit 708 which can be a Texas Instruments SN74LS244 integrated circuit. Circuit 708 is enabled by a signal on line 649 which causes each input to feed the signal thereon to a corresponding output. The outputs of circuit 708 are connected to respective lines of bus 135 for inputting information to buffer memories in the voice synthesizer circuits in parallel format during a write operation. Circuit 710 acts in conjunction with circuit 708 as a serial to parallel converter. Speech related information is presented to the data input of circuit 710 on line 130 and latched onto the output lines in accordance with addresses received from lines $A_2$, $A_3$ and $A_4$ of address bus 132. The clear input of circuit 710 is connected to reset line 131. In operation, information is presented on line 131 one bit at a time and latched onto the output lines one line at a time. When all eight output lines have the appropriate information latched onto them, buffer 708 is activated to transmit the information in parallel along bus 135 to the appropriate synthesizer circuit.

The complete operation of the system should be apparent from the foregoing description. However, in order to ensure an understanding of the invention, a detailed description of the major functions of the system will now be made.

SENSING INCOMING CALLS

Referring first to FIG. 1, an incoming call on line II causes an off hook signal to be transmitted along line 136 from DAA 102. FIG. 2 shows that the signal on line 136 causes LED 212 to be lit. The signal is passed along line 206 to circuit 702 of interrupt circuit 118. The signal is also delayed in time by operation of MMV 202 and flip flop 204 and passed along line 208 to NAND gate 712 of interrupt circuit 116. Interrupt circuit NAND gate 712, shown in FIG. 7, passes an interrupt signal on line 128 through NAND gate 624 of FIG. 6 to computer 100 in response to the delayed signal on line 208. At this time, NAND gate 624 has been enabled by a high output from circuit 600 on line 611 by a previous operation. Computer 100 responds by outputting signals to lines 126, and $A_1$ which cause circuit 600 of primary multiplexer 112 to be enabled upon the next occurrence of a high clock pulse on line 127. At the same time, data is passed along line 130 from the computer and lines $A_2$, $A_3$ and $A_4$ of data bus 132 are activated so as to latch the data onto line 604 causing that line to go high. Line $A_1$ is then dropped to a low state causing circuit 600 to be disabled and the output of NAND gate 618 to go high thus passing a low signal along line 645 to the strobe input of circuit 702 in FIG. 7. At this time, lines $A_2$, $A_3$ and $A_4$ of address bus 132 are actuated to sequentially access each of the input lines to circuit 702. This procedure continues until the off hook signal on line 206 is detected thus indicating to the computer that a call is present on telephone line II. It should be noted that the computer reads information from line 129 during a low state on clock line 127. During the next high state of clock line 127, circuit 700 of secondary multiplexer 113 is enabled through line 644 from NAND gate 635 of the primary multiplexer (FIG. 6) because all inputs of circuit 635 would then be high. With circuit 700 enabled, data is transmitted along line 130 and latched onto output line 205 by the computer sending the appropriate address signal on bus 132. This signal is an off hook acknowledge signal which is received by flip flop 204 of line control circuit 107 (FIG. 7) thus clearing the flip flop and removing the signal from line 208.

VOICE SYNTHESIS OPERATION

Voice data is generated in computer 100 (FIG. 1). The computer initially enables circuit 600 (FIG. 6) as discussed above and causes lines 604 and 605 to go low thus making the output of NOR gate 633 high. This output is an input to NAND gates 642 and 643. Line $A_1$ is dropped low by the computer thus causing the output of NAND gate 618 to go high making the second input of NAND gates 642 and 643 high. Upon a high clock pulse on line 127, the output of NAND gate 642 causes line 647 to go low thus enabling circuit 710 (FIG. 7). Upon each such transition of the clock pulse, one bit of information is transmitted to one of the output lines of circuit 710. The speech information generated in the computer is transmitted one bit at a time along line 130 to the data input of circuit 710. The correct output line for that data bit is addressed by bus 132. Once all of the output lines have the correct data bits latched onto them, the computer causes output lines 609 and 610 of circuit 600 (FIG. 6) to go high thus sending a low signal along line 512 and a high signal along line 510 to synthesizer chip 500 (FIG. 5) thereby enabling the write function on that chip. At the same time, due to the high signal on line 610, line 649 goes low to enable buffer 708 (FIG. 7) which then outputs in parallel format the byte of information received from circuit 710. This information is transmitted along bus 135 to circuit 500 into which the information is written. Clearly, the same operation would apply for writing information into the synthesizing circuit of section 103 (FIG. 6) except that the signals on lines 511 and 512 would be controlled to place that synthesizer in the write mode. While the information is being written, circuit 500 outputs a signal on line 506 which is inverted and passed along line 402 to status check circuit 122 (FIG. 4). The signal is presented directly on line 409 to circuit 400 and is delayed in circuits 404 and 406 and presented respectively on lines 410 and 411. Computer 100 raises line $A_1$ high again and interrogates the appropriate input line to circuit 400 through lines $A_2$, $A_3$ and $A_4$ of data bus 132 to determine the presence of a signal. These interrogations are conducted on a low state of clock line 127 so as not to inadvertently enable circuit 600 of the primary multiplexer. As long as a signal is received from circuit 400, the computer remains idle waiting for the write function to be completed. As soon as the write function is completed, a second byte of information is written into the buffer memory of synthesizer circuit 500 in the same manner as the previous byte. The information continues to be inputted one byte at a time until the buffer is loaded.

Synthesizer chip 500 outputs audio signals in response to the written information. The signals are sent through line 514, filter 516 and potentiomenter 518 to transformer 522 and output line 139 to DAA 102 and telephone line II. When the buffer memory has been depleted by one-half of the stored information, a signal is passed from synthesizer circuit 500 along line 504 to interrupt circuit 116, (FIG. 7). The signal on line 504 immediately causes an interrupt signal to be passed along line 128 to computer 100 which then interrogates circuit 702, as discussed above, to determine the cause of the interrupt. Once determined, the computer again inputs speech information to synthesizer chip 500 one byte at a time as discussed above.

In order to determine when all the stored information has been processed and output on line 514 by circuit 500, computer 100 enables circuit 600 (FIG. 6) of the primary multiplexer as discussed above. The computer then causes lines 604 and 606 to go low thus sending a high signal to gates 642 and 643. The computer also causes line 609 to go high and line 610 to go low. Buffer 708 (FIG. 7) is disabled by the signal on line 649 which is the low signal from line 610 inverted by inverter 632. The read function of synthesizer circuit 500 (FIG. 5) is enabled by a low signal on line 510 and a high signal on line 512 produced by lines 609 and 610. Computer 100 then drops line $A_1$ low causing the output of gate 618 (FIG. 6) to go high thus producing, with the output of gate 633, a low output on line 648. This enables the read function of synthesizer interface 120 (FIG. 7) by enabling circuit 706. When in the read mode, circuit 500 sends data in parallel format on bus 135. This data indicates the amount of speech information remaining to be synthesized. This data is read by computer 100 which sequentially addresses each input of circuit 706 such that the data on bus 135 is serially output along line 129. It should be noted that this accessing takes place during low cycles of clock line 127 so as not to inadvertently operate circuit 710.

While circuit 500 is outputting data onto bus 135, a signal is passed along lines 506 and 402 to circuit 400 (FIG. 4). This signal is sensed by computer 100 which waits until all data is output before performing its next function.

TOUCH TONE DECODE OPERATION

Tone signals are received on line 139 shown in FIG. 5 and transmitted through line 538 to the input of circuit 530. As soon as a tone signal is received and decoded, an output is transmitted along line 533 to lines 534 and 535. The signal on line 535 causes LED 542 to light while the signal on line 534 causes an interrupt to be generated through NAND gate 712 and line 128, (FIG. 7). Computer 100 receives the interrupt and interrogates circuit 702, as discussed above, to determine that the cause of the interrupt is circuit 530. The computer then enables circuit 704, (FIG. 7), through the primary multiplexer (FIG. 6) by enabling circuit 600, as discussed above, and causing line 606 to go high. Line $A_1$ is then dropped to the low state causing the output of NAND gate 618 to go high and thus causing line 646 to go low. The decoded information in circuit 530 (FIG. 5) is passed through bus 531, and buffer 532 to bus 133 which connects to four of the inputs of circuit 704 (FIG. 7). The computer addresses each of these inputs sequentially by appropriate addresses on address bus 132. As soon as the decoded information is serially inputted to the computer, circuit 700 is enabled by the primary multiplexer, as discussed above, and a signal is caused to be sent on line 536 to clear circuit 530. Each received tone is thus decoded and transmitted serially to the computer.

LINE HANG UP OPERATION

When all information has been received and/or transmitted, computer 100 disconnects the appropriate telephone line by enabling circuit 700 (FIG. 7) of secondary multiplexer 113, as discussed above and causing a signal to be transmitted along line 218 causing relay 214 (FIG. 2) to open contacts 215.

The above description is considered to be illustrative of the invention but should not be considered to limit the scope thereof. Additional modifications, additions and other changes can be made to the invention as would be obvious to one of ordinary skill in the art without departing from the scope thereof as set forth in the appended claims.

What is claimed as the invention is:

1. A system for receiving line signals including tone signals comprising tone coded information request messages from a telephone line, and transmitting synthesized human voice response messages along the same line, comprising:

a programmed computer;

line control circuit means connected to said telephone line for connecting said telephone line to said system and disconnecting said telephone line from said system and for producing an off hook signal in response to an incoming line signal on said telephone line;

tone decode circuit means connected to said telephone line for producing digital signals in response to received tone signals, said tone decode circuit means including means for producing a decoder status signal in response to a received tone signal;

voice synthesizing means connected to said telephone line for producing a synthesized voice signal, said voice synthesizing means including a storage buffer for storing data to be synthesized, and means for producing a buffer status signal when said buffer is loaded to a predetermined amount;

interface circuit means for establishing communication between said line control circuit means and said computer, between said voice synthesizing means and said computer, and between said computer and said tone decode circuit means, said interface circuit means including: interrupt circuit means connected to receive said off hook signal, said status decoder signal, and said buffer status signal; and causing an interrupt signal to be transmitted to said computer in response to said off hook signal, said status decoder signal or said buffer status signal status check means for storing an indication of the circuit causing said interrupt signal, and a tone decode interface for receiving digital signals from said tone decode circuit means and transmitting said digital signals to said computer in serial format;

said computer being programmed to interrogate said status check means in response to said interrupt signal and to communicate to said circuit causing said interrupt signal through said interface circuit means to selectively acknowledge an incoming call to said line control circuit means, provide response messages to be synthesized to said voice synthesizing means, and to accept digital signals from said tone decode circuit means through said tone decode interface, said computer further being programmed to determine appropriate responses to decoded request messages received through said tone decode interface and to load said storage buffer with data representing said response.

2. The system as set forth in claim 1, wherein said interface circuit means includes multiplexing control means for enabling individually said voice synthesizing circuit means or said tone decode circuit means.

3. The system as set forth in claim 2, wherein said multiplexing control means includes a first addressable latch circuit having an enable input and a data input connected to said computer and a plurality of addressable outputs, and a plurality of gate circuits connected to said outputs.

4. The system as set forth in claim 3, wherein said multiplexing control means further includes a second addressable latch circuit having an enable input connected to an output of one of said gate circuits, a data input connected to said computer and at least two addressable outputs connected to said line control circuit means and said tone decode circuit means, respectively.

5. The system as set forth in claim 4, wherein said first and second addressable latch circuits are connected to a common address bus from said computer, said outputs of said first latch circuit being addressed by a first set of addresses on said bus, said outputs of said second latch circuit being addressed by a second set of addresses on said bus.

6. The system as set forth in claim 5, wherein said status check means comprises a data selector circuit having a plurality of addressable inputs connected to receive said off hook signal, said decoder status signal and said buffer status signal, respectively, an enable input connected to an output of one of said gate circuits, a data output connected to said computer, and address inputs connected to said address bus, said inputs being addressed by said second set of addresses.

7. The system as set forth in claim 1, wherein said voice synthesizing means includes a synthesizing circuit having a memory, and a plurality of data terminals for writing information to be synthesized into said memory, and reading information out relating to the status of said memory, and said interface circuit means includes a synthesizing interface containing a serial/parallel converter for transmitting information from said computer to said terminals and a parallel/serial converter for transmitting information from said terminals to said computer.

8. A system for receiving line signals containing tone coded information request messages on at least two separate telephone lines and producing human voice response messages on the same lines, comprising:

a programmed computer;

a first telephone line;

a second telephone line;

a first processing section containing circuit means for processing signals received on said first telephone line, said first processing section including a first line control circuit means for producing a first off hook signal in response to a line signal on said first line;

a second processing section containing circuit means for processing signals received on said second telephone line, said second processing section including a second line control circuit means for producing a second off hook signal in response to a line signal on said second line;

each of said processing sections containing a separate tone decoder circuit for outputting digital codes in response to received analog tones, and voice synthesizer means for outputting synthesized human voice signals in response to data from said computer; and interface means connected to said first and second processing sections and to said computer for providing communication between said first and second processing sections, respectively, and said computer, said interface means including interrupt processing circuit means for receiving status indicative signals including said first and second off hook signals, respectively, from said first and second processing sections, and outputting an interrupt signal to said computer in response to said status indicative signals, said interface means including status indicator means for maintaining data indicative of the source of said interrupt signal;

said computer being programmed to interrogate said status indicator means in response to said interrupt circuit to determine the source of said interrupt signal and establish communication through said interface means with the processing section causing said interrupt signal.

9. The system as set forth in claim 8, wherein said interface means comprises a control section and status read/write section containing elements having addressable terminals, said elements being connected to a common address bus from said computer, said control section being constructed to respond to a first set of addresses on said bus and said status read/write section being constructed to respond to a second set of addresses on said bus.

10. The system of claim 9, wherein said status read/write section contains a plurality of elements, each of which is constructed to respond to said second set of addresses, said control section being constructed to individually enable each element of said status read write section in response to addresses of said first set.

11. The system of claim 10, wherein one element of said status read/write section is a status read circuit having inputs for receiving said status indicative signals from said first and second processing sections and being responsive to said addresses of said second set to transmit the signal on each input to said computer, when enabled by said control section.

12. The system of claim 10, wherein one element of said status read/write section is a status write circuit for controlling the status of said first and second processing sections, said status write circuit having a data input for receiving a data signal from said computer and transmitting said data signal to one of a plurality of outputs in response to addresses of said second set, when enabled by said control section.

13. The system as set forth in claim 12 or 11, wherein each tone decoder circuit outputs a signal responsive to a tone being received, which output signal is one of said status indicative signals.

14. The system as set forth in claim 12 or 11, wherein said voice synthesizer means contains a memory for storing said data from said computer and contains a status output for producing a status output signal when said memory is depleted by a predetermined circuit, said status output signal being one of said status indicative signals.

15. The system as set forth in claim 12 or 11, wherein each processing section contains a line control circuit for outputting an off hook signal in response to a telephone line signal, each off hook signal being one of said status indicative signals.

16. The system as set forth in claim 15, wherein said line control circuit contains a timing circuit for indicating the duration of a signal.

17. The system as set forth in claim 8, wherein said first processing section, said second processing section and said interface means are all contained on one printed circuit board.

18. A system for receiving signals from a telephone line including analog tone coded information request signals, processing said signals received on said telephone line and producing a human voice response signal on said telephone line, comprising:

a stored program computer;

a processing section connected to a receive signals from said telephone line and containing a tone decoder circuit for outputting parallel format digital codes in response to received analog tones, and a voice synthesizer circuit for outputting synthesized human voice signals in response to parallel format input data, said tone decoder circuit and said voice synthesizer circuit including means for producing, respectively, first and second status indicative signals representing an operational condition, respectively, of said tone decoder circuit and said voice synthesizer circuit; and interface means for providing communication between said processing section and said computer, said interface means including interrupt processing circuit means for receiving said status indicative signals from said processing section, and outputting an interrupt signal to said computer in response to said status indicative signals, said interface means further including means for storing data indicative of the circuit causing said interrupt signal, and said interface means including serial-to-parallel converter means for converting serial format data to parallel format data for said voice synthesizer circuit and parallel to serial converter means for converting parallel format data from said tone decoder circuit to serial format data for said computer;

said computer being programmed to interrogate said storing means and communicate with the circuit indicated by said storing means as causing said interrupt signal, said communication including receiving data from said tone decoder circuit through said parallel to serial converter, and passing data to said voice synthesizer through said serial-to-parallel converter.

* * * * *